United States Patent [19]

Dietz

[11] 4,078,879

[45] Mar. 14, 1978

[54] FUEL IGNITION SYSTEM CONTROL ARRANGEMENT PROVIDING TOTAL FUEL SHUTOFF AND CONTACT PROTECTION

[75] Inventor: Gerald Edward Dietz, Goshen, Ind.

[73] Assignee: Johnson Controls, Inc., Milwaukee, Wis.

[21] Appl. No.: 693,221

[22] Filed: Jun. 4, 1976

[51] Int. Cl.[2] ..... F23Q 9/08; F23Q 23/00; F23N 5/00

[52] U.S. Cl. ..... 431/51; 431/42; 431/71; 431/26

[58] Field of Search ..... 431/51, 42, 43, 71, 431/72, 73, 26

[56] References Cited

U.S. PATENT DOCUMENTS

| | | | |
|---|---|---|---|
| 2,989,117 | 6/1961 | Graves | 431/26 |
| 3,279,521 | 10/1966 | Munson et al. | 431/26 |
| 3,584,988 | 6/1971 | Hirsbrunner | 431/71 X |
| 3,902,839 | 9/1975 | Matthews | 431/51 X |

*Primary Examiner*—William F. O'Dea

*Assistant Examiner*—Larry Jones

*Attorney, Agent, or Firm*—Emrich, Root, O'Keeffe & Lee

[57] ABSTRACT

A control arrangement for a fuel ignition system to provide an interlock on start-up to prevent energization of fuel valves under certain failure conditions includes a pulse generating circuit operable when enabled to provide pulses for enabling a first switching device which energizes a pilot valve to supply fuel to a fuel outlet and prepares an energizing path for a main valve, and a second switching device enabled by a flame sensing circuit when a flame is established at the outlet to close associated contacts to complete the energizing path for the main valve and to cause the pulse generating circuit to continue to generate pulses for maintaining the first switching device enabled, the pulse generating circuit being inhibited whenever the contacts are closed at start-up, or close after the system is in a lock out state, preventing the enabling of the first switching device to maintain the pilot valve and the main valve deenergized.

16 Claims, 2 Drawing Figures

FUEL IGNITION SYSTEM CONTROL ARRANGEMENT PROVIDING TOTAL FUEL SHUTOFF AND CONTACT PROTECTION

BACKGROUND OF THE INVENTION

1. Field of the Invention

This invention relates to fuel ignition systems of the pilot ignition type and more particularly, to a control arrangement for use in such systems for providing an interlock on start-up under certain failure conditions.

2. Description of the Prior Art

In known fuel ignition systems of the pilot ignition type, a pilot valve is operated in response to the closure of thermostatically controlled contacts to supply fuel to a pilot outlet for ignition by a suitable igniter to establish a pilot flame. A pilot flame sensing circuit detects the pilot flame and effects the energization of a main valve which supplies fuel to a main burner apparatus for ignition by the pilot flame.

Typically, the operation of the main valve is controlled by a relay of the flame sensing circuit which has normally open contacts connected in the energizing path for the main valve and maintains the main valve deenergized until a pilot flame is established. When a pilot flame is established, the flame sensing circuit energizes the relay which then operates to close its contacts to connect the main valve to an energizing circuit to permit the main valve to operate. However, for a circuit failure which permits the relay of the flame sensing circuit to be energized at start up in the absence of a pilot flame, both the pilot valve and the main valve will be energized, permitting fuel to emanate from the pilot outlet and the main burner.

Various interlock arrangements have been proposed in the prior art, as exemplified by the U.S. Pat. Nos. 3,499,055 to J. C. Blackett, 3,644,074 to P. J. Cade and 3,709,783 to J. S. Warren, in which the energization of the fuel valves of the system is dependent upon the sequential operation of relays. In such systems, the energization of the pilot valve is effected in response to operation of a control relay which can be energized only is a flame sensing relay is deenergized. Once energized, the holding relay is maintained operated over a holding path provided by contacts of the relay. Thereafter, the energization of the main valve is effected in response to the operation of the flame sensing relay when a pilot flame is established, but only if the control relay is energized.

In such systems, the operation of the flame sensing relay is effected over an electric control circuit which is energized in response to the closing of thermostatically controlled contacts, and thus, for a failure of the control circuit which permits the flame sensing relay to be energized in the absence of a flame, the energization of the flame sensing relay may be delayed for a time following activation of the system. Accordingly, under certain conditions, the flame sensing relay may remain deenergized long enough to permit the control relay to operate, resulting in the unsafe condition referred to above with the pilot valve and main valve operated, and the igniter deenergized.

SUMMARY OF THE INVENTION

The present invention has provided a control arrangement for use in a fuel ignition system including pilot valve means operable to supply fuel to a pilot outlet for ignition to establish a pilot flame, and a flame sensing means responsive to the establishment of a pilot flame to enable an associated switching means for energizing a main valve means to supply fuel to a main burner apparatus for ignition by the pilot flame.

In accordance with the present invention, the control arrangement maintains the pilot valve means deenergized whenever the switching means is operated at startup and deenergizes the pilot valve in the event that the switching means is operated in the absence of a pilot flame. In addition, the control arrangement effects deenergization of the pilot valve means whenever a pilot flame fails to be established within a predetermined time, and thereafter maintains the system in a lock out state with both the pilot valve means and the main valve means deenergized, providing 100% shut off of fuel supply to fuel outlets of the system.

In accordance with a disclosed embodiment, the control arrangement includes control means including first switching means operable when enabled to effect the energization of the pilot valve means and to close first contacts which are connected in an energizing path for the main valve means, second switching means enabled by a flame sensing means when a flame is established to close second contacts to complete the energizing path for the main valve means, and enabling means operable when the second contacts are open to respond to a request signal to enable the first switching means.

The enabling means includes pulse generating means responsive to the request signal to provide pulses for effecting the enabling of the first switching means. The pulse generating means comprises a controlled switching device which is periodically rendered conductive under the control of a timing means which includes first and second capacitors which are charged at different rates to provide enabling signals for the controlled switching device. The controlled switching device is enabled each time the difference between the enabling signals reaches a predetermined value, and each time the controlled switching device conducts, a first one of the capacitors discharges over the controlled switching device, generating a pulse. The pulses thus generated enable the first switching means effecting the energization of the pilot valve means. The first switching means remains enabled as long as pulses are generated by the pulse generating means.

The control means further includes an inhibit means which controls the charging of the second one of the capacitors so that whenever the second contacts are open, the second capacitor continues to charge, and after a predetermined time which defines a trial for ignition period, becomes charged to a value which prevents enabling of the controlled switching device to inhibit further pulse generation, causing the first switching means to be disabled so that the pilot valve means is deenergized.

When a pilot flame is established within the predetermined time, the second switching means operates to close the second contacts which control the inhibit means to limit the charging of the second capacitor to a value which permits the controlled switching device to be enabled periodically, providing pulses for maintaining the first switching means and thus the pilot valve operated.

For the condition where the second contacts are closed at start-up, due to a failure of the flame sensing means which permits the second switching means to operate in the absence of a flame or in the event that the second contacts become welded together, then the inhibit means limits the charging of the second capacitor to a value that is insufficient to permit enabling of the controlled switching device, thereby inhibiting pulse generation and maintaining the first switching means and thus the pilot valve disabled.

In a further embodiment, the inhibit means includes a further switching means enabled when said second switching means operates after a lock out condition for the system to assure that the pulse generating means remains disabled.

Summarily, under normal operating conditions, the pulse generating means is operable when enabled to provide pulses which effect enabling of the first switching means to operate the pilot valve to supply fuel to the pilot outlet. When a pilot flame is established, the operation of the second switching means permits the pulse generating means to continue to generate pulses for maintaining the first switching means enabled. The pulse generating means is inhibited in the event the second contacts are closed at start-up or close following a lock out condition, and prevents operation of the first switching means so that the pilot valve means and the main valve means are maintained deenergized.

DESCRIPTION OF PREFERRED EMBODIMENTS

Figure 1:
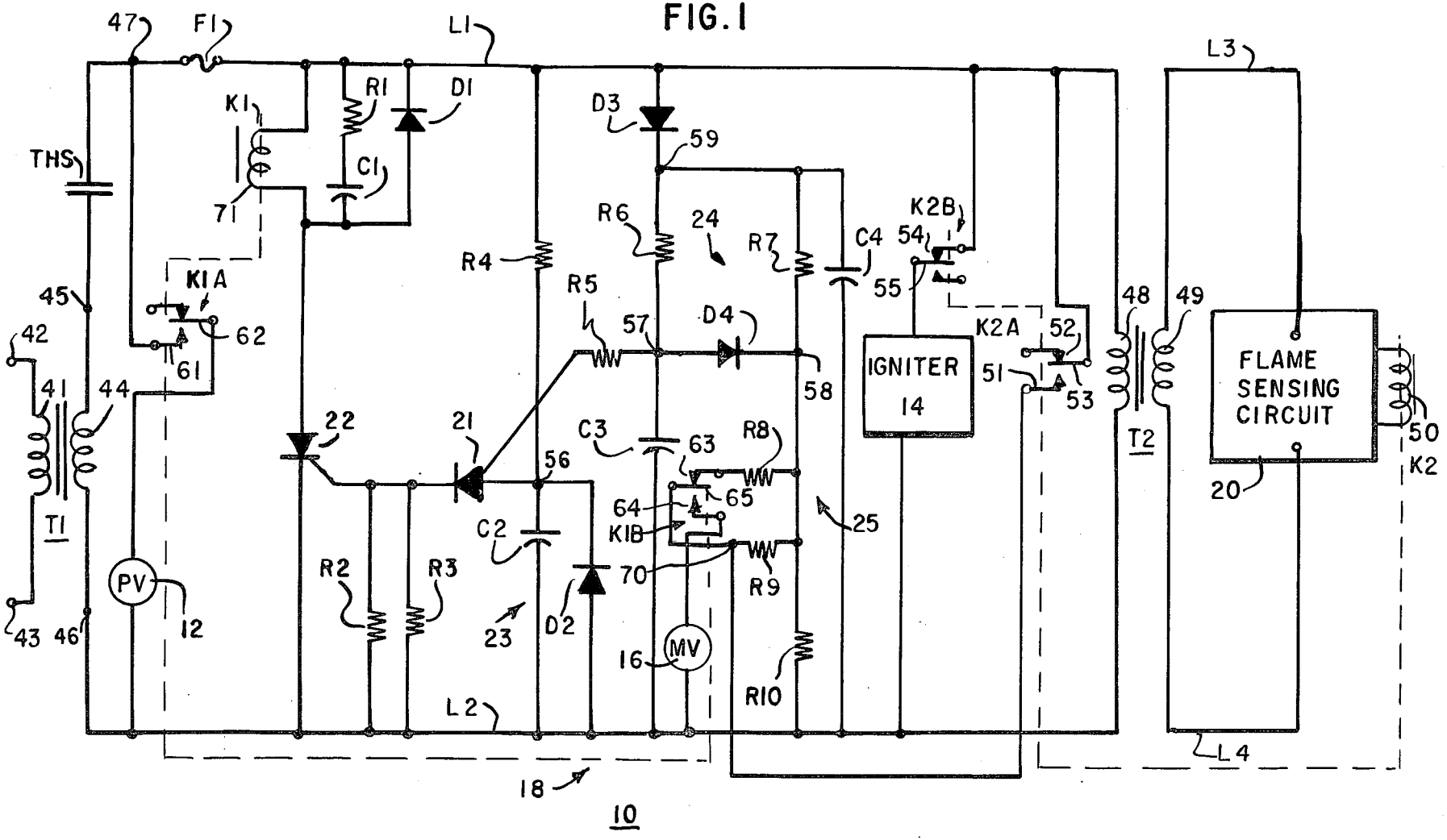
FIG. 1 is a schematic circuit diagram of a fuel ignition system including a control arrangement provided in accordance with one embodiment of the invention.

Referring to FIG. 1, there is shown a schematic circuit diagram for a fuel ignition system 10 provided in accordance with one embodiment of the invention. The system 10, which may be employed in a heating system, includes a pilot valve 12 which is operable when energized to supply fuel to a pilot outlet for ignition by ignition sparks provided by an igniter 14, a main valve 16 which is operable when energized to supply fuel to a main burner apparatus for ignition by the pilot flame, a control circuit 18, which controls the operation of the pilot valve 12 and the main valve 16, and a flame sensing circuit 20 which is operable when energized to respond to the pilot flame to effect the operation of the main valve 16.

The control circuit 18 provides an interlock function which protects against an unsafe failure of the flame sensing circuit 20 which permits an associated relay K2 to be enabled in the absence of a flame, or for the condition where contacts K2A, which control the main valve 16, become stuck in the closed position. The control circuit 18 also provides 100% shutdown of fuel in the event a pilot flame is not established within a predetermined time which defines a trial for ignition period, following the closing of thermostatically controlled contacts THS in response to a call for heat.

The control circuit 18 includes a controlled switching device 21, embodied as a programmable unijunction transistor (PUT), the operation of which is controlled by a pair of timing networks 23 and 24 which include timing capacitors C2 and C3, respectively. Capacitor C2 controls the anode potential for the PUT device 21, and capacitor C3 controls the gate potential for the PUT device 21. Timing capcitors C2 and C3 respond to an AC signal supplied over conductors L1 and L2 when contacts THS are closed to enable the PUT device 21 which in turn enables a further controlled switching device 22, embodied as a silicon control rectifier (SCR), to energize a relay K1 of the control circuit 18. When energized, relay K1 operates to close contacts K1A to connect the pilot valve 12 between conductors L1 and L2 for energization and to operate contacts K1B which are connected in the timing circuit 24. As will be described in detail hereinafter, under normal operating conditions, relay K1 enables the PUT device 21 to be rendered conductive during alternate half cycles of the AC signal for a predetermined time following operation of contacts THS to permit relay K1 to operate, and prevents the PUT device 21 from operating to maintain relay K1 deenergized, whenever contacts K2A of relay K2 of the flame sensing circuit 20 are closed at the time contacts THS close.

In addition, once relay K1 operates, the timing networks 23 and 24 enable the PUT device 21 to be rendered conductive for the duration of the trial for ignition period after which time the PUT device 21 is maintained non-conductive causing relay K1 to be deenergized.

More specifically, the charging of the capacitor C3, which enables the PUT device 21 to be turned on, is controlled by a diode D4 and a voltage divider network 25, including resistors R7–R10. When relay K1 is deenergized, the voltage divider network 25 provides a reverse bias for the diode D4, permitting capacitor C3 to charge to a value sufficient to cause the PUT device 21 to be enabled to effect energization of relay K1, which operates contacts K1B to prepare an energizing path for the main valve 16 permitting the main valve 16 to be energized under the control of the flame sensing circuit 20 when a pilot flame is established. When relay K2 is energized at the time contacts THS close, contacts K2A, which are connected to the timing network 24, are closed and diode 24 is forward biased, limiting the charging of capacitor C3 and maintaining the PUT device 21 disabled. Thus, relay K1 is maintained deenergized preventing operation of the pilot valve 12.

Contacts K1B of relay K1 are connected in the energizing path for the main valve 16 such that in order for the main valve 16 to be energized, both relay K1 and relay K2 must be energized. In the event of a failure condition of the type referred to above, relay K1 is maintained deenergized thereby preventing energization of the pilot valve 12 and the main valve 16.

Briefly, in operation, when thermostatically controlled contacts THS close in response to a request for heat, an AC signal is supplied between conductors L1 and L2 energizing the control circuit 18. In addition, the igniter 14 is energized over normally closed contacts K2B of relay K2 to generate ignition sparks in the proximity of the pilot outlet, and the flame sensing circuit 20 is energized over a transformer T2.

When the control circuit 18 is energized, capacitors C2 and C3 of timing circuits 23 and 24, respectively, charge in response to the AC signal provided on conductors L1 and L2, and when the anode-to-gate potential of the PUT device 21 exceeds a predetermined value, the PUT device 21 is rendered conductive, permitting capacitor C2 to discharge into the gate of the SCR device 22, which conducts enabling relay K1 which then operates. When relay K1 operates, the pilot valve 12 is energized over contacts K1A and fuel is supplied to the pilot outlet for ignition by the ignition sparks provided by the igniter 14.

In addition, contacts K1B operate to prepare an energizing path for the main valve 16. When a pilot flame is established and sensed by the flame sensing circuit, relay K2 operates to close contacts K2A to energize the main valve 16 and to open contacts K2B to disable the igniter 14. Also, when contacts K2A close, diode D4 is forward biased, limiting the voltage across capacitor C3 to a value which permits the PUT device 21 to be rendered conductive during each cycle of the AC signal to thereby maintain relay K1 operated.

For the condition where a pilot flame fails to become established within the trial for ignition period, capacitor C3 charges to a voltage that prevents enabling of the PUT device 21 causing relay K1 to be deenergized. Also, in the event that contacts K2A are closed when contacts THS close, then diode D4 is forward biased preventing capacitor C3 from charging to a value sufficient to enable the PUT device 21 to conduct. Accordingly, relay K1 is maintained deenergized, preventing operation of the pilot valve 12 and the main valve 16.

DETAILED DESCRIPTION

Considering the fuel ignition system 10 in more detail, power is supplied to the system 10 over an input transformer T1 which has a primary winding 41 connected to input terminals 42 and 43, which are connectable to a 24 volt, 60 Hz voltage source, and a secondary winding 44 connected to terminals 45 and 46. Conductor L1 is connected over a fuse F1 and normally open thermostatically controlled contacts THS to terminal 45, and conductor L2 is connected directly to terminal 46.

The flame sensing circuit 20 is energized over a transformer T2 which has a primary winding 48 connected between conductors L1 and L2, and a secondary winding 49 connected between conductors L3 and L4 which are connected to input terminals of the flame sensing circuit 20. Accordingly, the flame sensing circuit 20 is energized whenever the thermostatically controlled contacts THS are closed.

The flame sensing circuit 20 may be the type disclosed in the U.S. Pat. No. 3,902,839 of R. B. Matthews, which issued on Sept. 2, 1975. The operation of the flame sensing circuit is described in detail in the referenced patent. As shown in the referenced patent, the flame sensing circuit includes a flame sensing electrode which is positioned adjacent the pilot outlet and a control circuit which responds to the presence of a flame at the sensing electrode to effect energization of the operate winding 50 of relay K2 to operate contacts K2A and K2B. Relay K2 comprises a double pole double throw relay (DPDT) with contacts K2A, illustrated in the open position in FIG. 1, comprising contact members 51 and 52, and one pole 53 of the relay K2. Whenever contact member 51 engages pole 53, contact member 52 is disengaged from pole 53. Also, should contact member 51 become welded to the pole 53, contact member 52 cannot reengage the pole 53 when the relay K2 is deenergized. The pole 53 is connected to conductor L1 and contact member 51 is connected to the timing circuit 23 at point 70.

The other contacts K2B of relay K2 include contact member 54 which normally engages pole 55. Contact member 54 is connected to conductor L1 and pole 55 is connected to an input of the igniter 14. Accordingly, when relay K2 is deenergized, the igniter 14 is connected between conductors L1 and L2. The igniter 14 may be of the type disclosed in the U.S. Pat. No. 3,902,839 referenced above, and the operation of the igniter is disclosed in detail in the patent.

Digressing, relay K1 is also a double pole, double throw relay and contacts K1A include a contact member 61 which is normally disengaged from a pole 62 when relay K1 is deenergized. Contact member 61 is connected to one side of contacts THS at point 47, and pole 62 is connected to one side of the pilot valve 12 the other side of which is connected to conductor L2. Contacts K1B of relay K1 include contact members 63 and 64 and a pole 65. When the contacts K1B are in the open position as illustrated in FIG. 1, the pole 65 engages contact member 63, and when the contacts K1B are operated to a closed position the pole 65 is moved to engage contact member 64.

Referring to the control circuit 18, the PUT device 21 may be the Type SPU 35 programmable unijunction transistor, commercially available from Motorola. The potential at the anode electrode of the PUT device 21 is determined by the timing network 23 which includes capacitor C2 and a resistor R4, connected in series between conductors L1 and L2 with the anode electrode of the PUT device 21 being connected to the junction of the resistor R4 and capacitor C2 at point 56. Accordingly, a charging path is provided for capacitor C2 from conductor L1 over resistor R4 and capacitor C2 to conductor L2 permitting capacitor C2 to charge during positive half cycles of the AC signal, that is when conductor L1 is positive relative to conductor L2. A diode D2 is connected in parallel with capacitor C2, providing a discharge path for the capacitor C2 during negative half cycles of the AC signal, when conductor L2 is positive relative to conductor L1, in the event the PUT device is not enabled.

The potential at the gate of the PUT device 21 is determined by timing network 24, which includes capacitor C3, diode D4 and voltage divider network 25. Capacitor C3 is connected in series with a diode D3 and a resistor R6 between conductors L1 and L2 and is charged during positive half cycles of the AC line signal. A resistor R5 is connected between the junction of resistor R6 and capacitor C3 at point 57 and the gate electrode of the PUT device 21 to extend the potential at point 57 to the gate of the PUT device 21. Diode D4 has its anode connected to point 57 and its cathode connected to the junction at point 58 of resistors R7 and R10 of the voltage divider network 25, which are connected in series between the junction of diode D3 and resistor R6 at point 59 and conductor L2. A capacitor C4 is connected in parallel with resistors R7 and R10. The voltage divider network 25 further includes resistors R8 and R9 which are connected in parallel over contacts K1B whenever relay K1 is deenergized. Resistor R8 is connected between point 58 and contact member 63 of contacts K1B, and resistor R9 is connected between point 58 and the pole 65 of contacts K1B, which is also connected to contact member 51 of contacts K2A at point 70. Accordingly, whenever contacts K2A are open as illustrated in FIG. 1, the ends of resistors R8 and R9 which are connected to point 70 are floating.

Resistors R7 and R10 normally provide a reverse bias for diode D4 at the cathode thereof. When contacts K2A are closed as the result of operation of relay K2, point 70 is connected to conductor L1, decreasing the potential at point 58 during negative half cycles of the AC signal, permitting diode D4 to be forward biased. Also, when contacts K1B operate such that pole 65 engages contact member 64, resistor R8 is disconnected from the circuit while resistor R9 remains connected between points 58 and 70 to cause the potential at point 58 to be decreased, when relay K2 is operated, to a value to permit diode D4 to become forward biased to clamp the voltage across capacitor C3 at a level which permits the PUT device 21 to conduct during each cycle of the AC signal for maintaining relay K1 operated.

During positive half cycles of the AC signal, capacitor C3 charges at a first rate to provide a potential at point 57 which is extended over resistor R5 to the gate of the PUT device 21. Capacitor C2 charges at a second, slower rate to provide a potential at point 56, which is connected to the anode of the PUT device 21.

The PUT device 21 is normally non-conducting and is rendered conductive whenever the potential at the anode electrode exceeds the potential at the gate electrode by approximately 0.6 volts as determined by the action of the timing networks 23 and 24.

Whenever the PUT device 21 is rendered conductive, a discharge path is provided for capacitor C2 over the anode-cathode circuit of the PUT device 21 which supplies pulses to the gate electrode of SCR device 22, which may be the type C106B manufactured by General Electric Co.

The SCR device 22, which is normally non-conductive, has an anode-cathode circuit connected in series with the operate coil 71 of relay K1 between conductors L1 and L2. The gate electrode of the SCR device 22 is connected over a resistor R2 to the conductor L2, a redundant resistor R3 being connected in parallel with the resistor R2 for safety purposes. A resistor R1 and a capacitor C1 are connected in parallel with the operate coil 71 of relay K1, to maintain the relay operated during positive half cycles of the AC line signal when the SCR device 22 is non-conducting. A diode D1 is connected in parallel with relay operate coil 71 and acts as a free wheeling diode to maintain the flux in coil 71 upon reversal of polarity for a half cycle, thereby preventing relay K1 from dropping out or chattering.

Relay coil 71 has a low resistance of approximately 450 ohms. The fuse F1 is connected in the energizing path for the relay coil 71. Accordingly, in the case of a short circuit condition for the SCR device 22, current flow over the energizing branch, which includes the SCR device 22, changes from half wave to full wave, thereby blowing the fuse and deenergizing the relay K1.

Relay K1 is operable when energized to close contacts K1A to effect operation of the pilot valve 12 and to close contacts K1B, which are connected in timing circuit 24 to prepare an energizing circuit for the main valve 16.

OPERATION

For the purpose of illustrating the operation of the fuel ignition system 10, it is assumed initially that the PUT device 21 and the SCR device 22 are cut-off and that relays K1 and K2 are deenergized. When contacts THS close in response to a request for heat, the 60 Hz, 24 VAC supplied over the input transformer T1 is extended to conductors L1 and L2, energizing the control circuit 18 to effect operation of relay K1 and the pilot valve 12, and energizing the igniter 14 which operates to generate ignition sparks in the proximity of the pilot outlet. Also, when power is applied to conductors L1 and L2, the flame sensing circuit 20 is energized over transformer T2.

Referring to the control circuit 18, during the first positive half cycle of the AC line signal applied between conductors L1 and L2, when conductor L1 swings positive relative to conductor L2, current flows from conductor L1 through resistor R4 and capacitor C2 to conductor L2, permitting capacitor C2 to charge and providing a voltage at point 56 which is connected to the anode of the PUT device 21, establishing an anode potential for the PUT device 21.

During the same half cycle, capacitor C3 is charged over a path extending from conductor L1 over diode D3, resistor R6 and capacitor C3 to conductor L2, establishing a potential at point 57 which is extended over resistor R5 to the gate of the PUT device 21. Since relays K1 and K2 are deenergized, the voltage provided at point 58 by resistors R7 and R10 maintains diode D4 reverse biased, allowing the capacitor C3 to charge toward the peak value of the line signal.

The values of capacitors C2 and C3 are selected such that when the AC line signal is at its peak value during the positive half cycle, the anode to gate potential of the PUT device 21 exceeds +0.6 volts. Accordingly, the PUT device 21 conducts, permitting capacitor C3 to discharge over the anode-cathode circuit of the PUT device 21, supplying gate current to the SCR device 22 to enable the SCR device 22 to conduct.

When the SCR device 22 conducts, an energizing path is completed between conductors L1 and L2 for relay K1 which then operates to close contacts K1A to energize the pilot valve 12 which then operates to supply fuel to the pilot outlet for ignition by sparks provided by the igniter 16. In addition, contacts K1B close to prepare an energizing path for the main valve 14.

During the next half cycle of the AC line signal, when conductor L2 swings positive relative to conductor L1, the SCR device 22 is cut off. However, capacitor C1, which is charged during the time the SCR device 22 is enabled, maintains relay K1 energized during the negative portion of the half cycle of the line voltage in which the SCR device 22 is non-conductive. The control circuit 18 continues to provide enabling pulses to the gate of the SCR device 22 during positive half cycles of the AC line signal until a pilot flame is established at the pilot outlet.

When the fuel supplied to the pilot outlet is ignited, the flame sensing circuit 20 responds to the pilot flame to energize relay K2 which operates to close contacts K2A to energize the main valve 16, permitting fuel to be supplied to the main burner apparatus for ignition by the pilot flame. In addition, contacts K2B are opened deenergizing the igniter 14.

When contacts K2A operate, resistor R9 is connected to conductor L1 over contact member 51 and pole 53 contacts K2A, and accordingly, the potential at point 58 is decreased to a value that allows the diode D4 to conduct when the voltage across capacitor C3 increases to a value at which the voltage at the anode of diode D4 is 0.6 volts greater than the voltage provided at the cathode of diode D4 at point 58. Once this voltage has been reached, the voltage across capacitor C3 is clamped at a value which permits the PUT device 21 to conduct during each positive half cycle when the potential at the anode electrode, as provided by the charging of capacitor C2, exceeds the gate potential by 0.6 volts, enabling the SCR device 22 to maintain the relay K1 energized.

When the heating demand has been met, contacts THS open, deenergizing the pilot valve 12, the main valve 16, the relay K1 and the flame sensing circuit 20. At such time, the cathode voltage of diode D4 goes to zero and capacitor C3 discharges over diode D4 and resistor R10.

As indicated above, the control circuit 18 provides 100% shut off of fuel supply for the condition where a pilot flame fails to be established within a trial for ignition time of a predetermined duration. Assuming the system 10 has been activated through the operation of contacts THS and that relay K1 has operated and the pilot valve 12 is energized, capacitor C3 normally continues to charge during successive cycles of the AC line signal, enabling the PUT device 21 to conduct during each cycle to discharge capacitor C2 and enable the SCR device 22. However, after a predetermined time, capacitor C3 is charged to a value which provides a voltage at point 57 such that the charging of capacitor C2 cannot raise the anode potential of the PUT device 21 to a value of 0.6 volts above the gate potential of the PUT device 21 as provided by capacitor C3. Accordingly, the PUT device 21 stops firing, maintaining the SCR device 22 non-conductive, permitting relay K1 to drop out, deenergizing the pilot valve 12. The system 10 is maintained in a lock out condition with both the pilot valve 12 and the main valve 16 deenergized until contacts THS are opened, permitting capacitor C3 to discharge over diode D4 and resistor R10.

In the event of a failure condition in the flame sensing circuit 20 which permits relay K2 to be operated in the absence of a pilot flame or for the condition where contact member 51 and pole 53 of contacts K2A become welded together, the control circuit 18 is operable to maintain relay K1 deenergized thereby maintaining both the pilot valve 12 and the main valve 16 deenergized.

If contacts K2A are closed at the time contacts THS close in response to a request for heat, then resistors R8 and R9 are connected in parallel over contacts K1B of relay K1 between conductor L1 and point 58 of the voltage divider network 25. Accordingly, when power is applied to conductors L1 and L2, the potential at the cathode of diode D4 at point 58 is decreased to a value such that capacitor C3 cannot charge to a voltage sufficient to cause the PUT device 21 to fire. Accordingly, relay K1 is not energized as long as contacts K2A remain closed and the system 10 is maintained in a lock out condition.

SECOND EMBODIMENT

Figure 2:
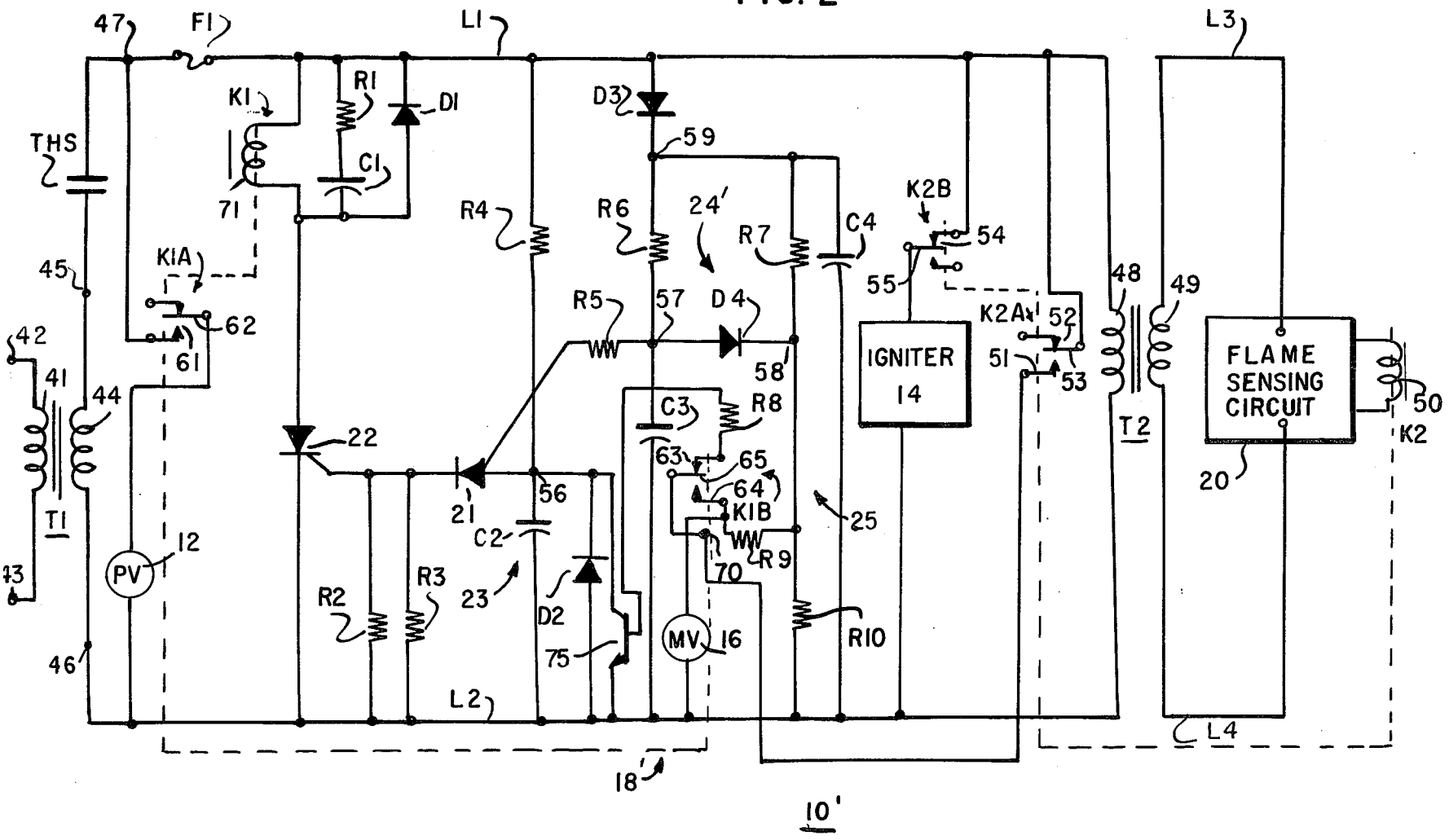
FIG. 2 is a schematic circuit diagram of a fuel ignition system including a control arrangement provided in accordance with a second embodiment of the invention.

Referring to FIG. 2, there is shown a schematic circuit diagram for a fuel ignition system 10' provided in accordance with a second embodiment of the invention. The system 10' is generally similar to the system 10 shown in FIG. 1 and accordingly, corresponding elements have been given like reference numbers.

Briefly, the system 10' includes a pilot valve 12, an igniter 14, a main valve 16, a flame sensing circuit 20 and a control circuit 18', which is generally similar to control circuit 18 of system 10 shown in FIG. 1 for controlling the operation of the pilot valve 12 and the main valve 16.

The system 10' shown in FIG. 2 protects against a failure which occurs in the flame sensing circuit 20 at the start of an ignition cycle as described above with reference to FIG. 1. The system 10' further protects against a failure in the flame sensing circuit 20 after the control circuit 18' has placed the system 10' in a lock out state.

In the system 10', the control circuit 18' includes a transistor 75 which prevents the PUT device 21 from firing if the normally open contacts K2A of relay K2 and the normally closed contacts K1B of relay K1 are in the closed position. For such condition, the control circuit 18' prevents energization of the pilot valve 12 and the main valve 16.

Referring to the control circuit 18' illustrated in FIG. 2, the control circuit 18' is generally similar to control circuit 18 described above and includes PUT device 21, the enabling of which is controlled by timing networks 23 and 24', which include respective capacitor C2 and C3 which establish a turn on threshold for the PUT device 21 for enabling the SCR device 22 in the manner described above. However, timing circuit 24' includes normally non-conducting transistor 75 which has its collector-emitter circuit connected in parallel with capacitor C2 between the anode of the PUT device 21 and conductor L2. In addition, resistor R8 is connected between contact member 63 of contacts K1B and the base of transistor 75 rather than to point 58 as in control circuit 18.

OPERATION

The system 10' is operable to effect energization of the pilot valve 12 and the main valve 16 in the manner of system 10 as described above for a start up condition when contacts K2A of relay K2 are open, and to effect shut down of the system in the event a pilot flame fails to be estalbished within the trial for ignition period.

Assuming that contacts K2A are closed at start up such that pole 53 engages contact member 51, then, when contacts THS close to apply power to conductors L1 and L2, current flows over contacts K2A of relay K2, contacts K1B of relay K1 and over resistor R8 to the base of transistor 75, which then conducts, shorting the anode of the PUT device 21 to conductor L2 and no voltage is present across capacitor C2. Accordingly, the PUT device 21 and the SCR device 22 are maintained non-conducting, preventing energization of relay K1.

Similarly, if contacts K2A were open at start up, but the control circuit 18' has placed the system 10' in a lock out condition, as for example due to lack of a pilot flame within the trial for ignition period, then relay K1, and thus the pilot valve 12 and the main valve 16, are deenergized. Under such conditions, for a failure of the flame sensing circuit 20 which permits relay K2 to operate, the control circuit 18' maintains the system 10' in a lock out state.

When contacts K2A close following the failure of the flame sensing circuit 20, current flow over contacts K2A and K1B and resistor R8 causes transistor 75 to conduct, preventing operation of the PUT device 21 as described above thereby preventing energization of the pilot valve 12 and the main valve 16.

In one embodiment, the resistor and capacitors of the fuel ignition control systems 10 and 10' shown in FIGS. 1 and 2 had the following values:

| Resistors | Capacitors |
|---|---|
| R1 = 100 ohms | C1 = 10 microfarads |
| R2 = 220 ohms | C2 = 47 microfarads |
| R3 = 220 ohms | C3 = 10 microfarads |
| R4 = 56K ohms | C4 = 10 microfarads |
| R5 = 2.2 megohms | |
| R6 = 18 megohms | |
| R7 = 10K ohms | |
| R8 = 10K ohms | |
| R9 = 18K ohms | |

-continued

| Resistors | Capacitors |
|---|---|
| R10 = 3.3K ohms | |

The component values listed above are representative of an illustrative embodiment, and are not intended as a limitation on the scope of the invention.

I claim:

1. In a fuel ignition system including pilot valve means operable when energized to supply fuel to a pilot outlet for ignition to establish a pilot flame, main valve means operable when energized to supply fuel to a main burner apparatus for ignition by the pilot flame, and flame sensing means responsive to the establishment of a pilot flame for effecting energization of said main valve means, a control arrangement comprising control means including first switching means operable when enabled to effect the energization of said pilot valve means to supply fuel to said outlet for ignition and to close first contacts which are connected in a first portion of an energizing path for said main valve means, second switching means enabled by said flame sensing means when a flame is established to close second contacts which are connected in a second portion of said energizing path to complete said energizing path for said main valve means, enabling means operable when said second contacts are open to respond to a request signal to enable said first switching means, and inhibit means connected between said second portion of said energizing path and said enabling means, and controlled by said first and second switching means to prevent said enabling means from responding to said request signal whenever said second contacts are closed and said first contacts are open whereby said first switching means is maintained disabled.

2. A system as set forth in claim 1 wherein said enabling means includes timing means for causing said first switching means to be disabled whenever a flame fails to be established within a predetermined time following the occurrence of said request signal to thereby interrupt said energizing path for said main valve means and to deenergize said pilot valve means.

3. A system as set forth in claim 2 wherein said inhibit means includes further switching means operable whenever said second switching means is enabled after said first switching means is disabled by said enabling means when a flame fails to be established within said predetermined time, to prevent reenabling of said first switching means.

4. A system as set forth in claim 1 wherein said enabling means includes pulse generating means responsive to said request signal to provide pulses for effecting the enabling of said first switching means, said inhibit means including further switching means enabled whenever said first contacts are open and said second contacts are closed to inhibit said pulse generating means to prevent enabling of said first switching means.

5. In a fuel ignition system including pilot valve means operable when energized to supply fuel to a pilot outlet for ignition to establish a pilot flame, main valve means operable when energized to supply fuel to a main burner apparatus for ignition by the pilot flame, and flame sensing means responsive to the establishment of a pilot flame for effecting energization of said main valve means, a control arrangement comprising first switching means operable when energized to complete a first portion of an energizing path for said main valve means and to connect said pilot valve means to a source of energizing potential for operation to supply fuel to said outlet for ignition, pulse generating means responsive to a request signal to provide pulses for effecting the energization of said first switching means, second switching means energized by said flame sensing means when a pilot flame is established to complete a second portion of said energizing path for said main valve means, and inhibit means connected between said second portion of said energizing path and said pulse generating means and controlled by said first and second switching means for inhibiting said pulse generating means to prevent the energization of said first switching means whenever said second portion of said energizing path is completed before said first switching means operates to complete said first portion of said energizing path.

6. A system as set forth in claim 5 wherein said pulse generating means includes timing means operable to inhibit said pulse generating means whenever a pilot flame fails to be established within a predetermined time to permit said first switching means to be deenergized to interrupt said energizing path for said main valve means and to deenergize said pilot valve means.

7. A system as set forth in claim 5 wherein said pulse generating means includes a controlled switching device, and first and second timing means operable when enabled responsive to said request signal to provide respective first and second control outputs for enabling said controlled switching device to effect the generation of pulses.

8. A system as set forth in claim 7 wherein said first switching means is operable to close first contacts to complete said first portion of said energizing path, and said second switching means is operable to close second contacts to complete said second portion of said energizing path.

9. A system as set forth in claim 8 wherein said inhibit means is connected between said second portion of said energizing path and said second timing means, and is operable to permit said second timing means to be enabled whenever said first and second contacts are closed, said inhibit means disabling said second timing means whenever said first contacts are open and said second contacts are closed.

10. In a fuel ignition system including pilot valve means operable when energized to supply fuel to a pilot outlet for ignition to establish a pilot flame, main valve means operable when energized to supply fuel to a main burner apparatus for ignition by the pilot flame, and flame sensing means responsive to the establishment of a pilot flame for effecting energization of said main valve means, a control arrangement comprising control means including first switching means operable when energized to close first contacts to complete a first portion of an energizing path for said main valve means and to connect said pilot valve means to a source of energizing potential for operation to supply fuel to said outlet for ignition, and pulse generating means including a controlled switching device, and first and second timing means operable when enabled responsive to a request signal to provide respective first and second control outputs for enabling said controlled switching device to provide pulses for effecting the energization of said first switching means, second switching means energized by said flame sensing means when a pilot flame is established to close second contacts to complete a second portion of said energizing path for said main valve means, said control means including inhibit means having third switching means and circuit means for disabling said third switching means whenever at least said second contacts are open, said circuit means enabling said third switching means to extend a control signal at a first level to said second timing means whenever said first and second contacts are closed to permit said second timing means to provide its control output, and to extend a control signal at a second level to said second timing means whenever said first contacts are open and said second contacts are closed to prevent said second timing means from providing its control output, thereby inhibiting said pulse generating means to prevent the energization of said first switching means whenever said second portion of said energizing path is completed before said first switching means operates to complete said first portion of said energizing path.

11. A system as set forth in claim 10 wherein said third switching means comprises diode means and said circuit means includes voltage divider means connected to a source of energizing potential for normally providing a reverse bias for said diode means whenever at least said second contacts are closed, said voltage divider means being controlled by said first and second contacts to provide a forward bias for said diode means to permit said control signals to be extended to said second timing means.

12. A system as set forth in claim 11 wherein said inhibit means includes fourth switching means, said fourth switching means being normally disabled and being enabled to prevent enabling of said controlled switching device whenever said first contacts are open and said second contacts are closed.

13. In a fuel ignition system including pilot valve means operable when energized to supply fuel to a pilot outlet for ignition to establish a pilot flame, main valve means operable when energized to supply fuel to a main burner apparatus for ignition by the pilot flame, and flame sensing means responsive to the establishment of a pilot flame for effecting energization of said main valve means, a control arrangement comprising control means including first switching means operable when energized to connect said pilot valve means to a source of energizing potential for operation to supply fuel to said outlet for ignition, and to complete a first portion of an energizing path for said main valve means, pulse generating means operable when enabled to provide pulses for effecting the energization of said first switching means, second switching means energized by said flame sensing means when a pilot flame is established to complete a second portion of said energizing path for said main valve means, said pulse generating means including timing means for inhibiting said pulse generating means whenever a pilot flame fails to be established within a predetermined time to permit said first switching means to be deenergized to interrupt said energizing path for said main valve means and to deenergize said pilot valve means for maintaining said system in a lock out state, said second switching means being operable when energized to override said timing means to permit said pulse generating means to continue to provide pulses to maintain said first switching means energized, and inhibit means controlled by said first and second switching means for causing said timing means to inhibit said pulse generating means to prevent the energization of said first switching means whenever said second portion of said energizing path is completed before said first switching means operates to complete said first portion of said energizing path.

14. A system as set forth in claim 13 wherein said inhibit means is enabled in response to operation of said second switching means when said system is in a lock out state to prevent said pulse generating means from providing pulses.

15. In a fuel ignition system including pilot valve means operable when energized to supply fuel to a pilot outlet for ignition to establish a pilot flame, main valve means operable when energized to supply fuel to a main burner apparatus for ignition by the pilot flame, and flame sensing means responsive to the establishment of a pilot flame for effecting energization of said main valve means, a control arrangement comprising control means including first switching means operable when energized to connect said pilot valve means to a source of energizing potential for operation to supply fuel to said outlet for ignition, pulse generating means operable when enabled to provide pulses for effecting the energization of said first switching means, activate means responsive to a request signal for connecting said pulse generating means to a source of a cyclical AC signal, for enabling said pulse generating means, said pulse generating means including a controlled switching device and timing means which includes first capacitor means responsive to said AC signal for charging toward a given potential at a first rate to provide an increasing potential at a first control input of said controlled switching device, and second capacitor means responsive to said AC signal for charging toward said given potential at a second rate to provide an increasing potential at a second control input of said controlled switching device, said controlled switching device being enabled whenever the potential difference between its first and second control inputs reaches a predetermined value to permit said first capacitor means to discharge over said controlled switching device for providing said pulses for enabling said first switching means, second switching means energized by said flame sensing means when a pilot flame is established to complete an energizing path for said main valve means, said timing means inhibiting said controlled switching device, presenting pulse generation whenever a pilot flame fails to be established within a predetermined time to permit said first switching means to be deenergized to interrupt said energizing path for said main valve means and to deenergize said pilot valve means for maintaining said system in a lock out state, said second switching means being operable when energized, when said first switching means is energized, to override said timing means to permit said pulse generating means to continue to provide pulses to maintain said first switching means energized.

16. A system as set forth in claim 15 wherein said control means includes inhibit means for controlling the charging of said second capacitor means for normally permitting said second capacitor means to charge to a value which prevents the potential difference between said control inputs from reaching said predetermined value thereby inhibiting said controlled switching device, said second switching means being operable when energized to control said inhibit means to limit the charging of said second capacitor means to permit the potential difference between said first and second control inputs to reach said predetermined value permitting said first capacitor means to charge during each cycle of said AC signal and to discharge over said controlled switching device to effect the generation of pulses for maintaining said first switching means enabled.

* * * * *

UNITED STATES PATENT AND TRADEMARK OFFICE

CERTIFICATE OF CORRECTION

PATENT NO. : 4,078,879

DATED : March 14, 1978

INVENTOR(S) : Gerald Edward Dietz

It is certified that error appears in the above-identified patent and that said Letters Patent are hereby corrected as shown below:

Column 14, line 41, "presenting" should be "preventing".

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*